US005460333A

United States Patent [19]

Vanhuyse

[11] Patent Number: 5,460,333

[45] Date of Patent: Oct. 24, 1995

[54] METHOD APPARATUS AND SPOOL FOR AUTOMATED WINDING

[75] Inventor: Hervé Vanhuyse, Bavikhove, Belgium

[73] Assignee: N.V. Bekaert S.A., Zwevegem, Belgium

[21] Appl. No.: 82,972

[22] Filed: Jun. 29, 1993

[30] Foreign Application Priority Data

Jul. 21, 1992 [EP] European Pat. Off. ..... 92202229

[51] Int. Cl.[6] ..... B65H 75/14; B23Q 3/00; B21F 9/02

[52] U.S. Cl. ..... 242/25 R; 242/118.4; 242/125.1; 29/464; 140/92.2

[58] Field of Search ..... 242/25 R, 25 A, 242/118.4, 532, 18 PW, 125, 125.1, 125.2; 29/428, 464; 140/92.2

[56] References Cited

U.S. PATENT DOCUMENTS

| | | | |
|---|---|---|---|
| 1,456,108 | 5/1923 | Johannesen | 242/118.4 |
| 3,272,454 | 9/1966 | Lane et al. | 242/125.1 X |
| 3,994,058 | 11/1976 | Sasaki et al. | 242/25 R X |
| 4,019,543 | 4/1977 | Sasaki et al. | 242/25 R X |
| 4,026,483 | 5/1977 | Skalleberg | 242/25 R |
| 4,160,532 | 7/1979 | Demuth et al. | 242/125.1 |
| 4,292,114 | 9/1981 | Engmann et al. | 242/18 PW X |

FOREIGN PATENT DOCUMENTS

| | | |
|---|---|---|
| 0267157 | 5/1988 | European Pat. Off. . |
| 2914898 | 10/1980 | Germany . |
| 3110663 | 9/1982 | Germany . |

*Primary Examiner*—Daniel P. Stodola
*Assistant Examiner*—Michael R. Mansen
*Attorney, Agent, or Firm*—Foley & Lardner

[57] ABSTRACT

A spool (10) where an elongated metal element (25) is to be wound, comprises a core ( 12 ) and two flanges ( 14 ). The core (12) and/or the flanges (14) comprise at least one reference mark (18). The core comprises at least one fixing hole (16). At least one of the fixing holes (16) is located at a predetermined distance from the reference mark (18). The leading end of the elongated element is plastically bent. Next the reference mark (18) is located and the bent part of the elongated element (25) is put into one of the fixing holes (16). Thereafter the elongated element (25) is wound on the spool (10).

25 Claims, 3 Drawing Sheets

METHOD APPARATUS AND SPOOL FOR AUTOMATED WINDING

The invention relates to a method of and an apparatus for winding an elongated metal element to a spool. The invention also relates to a spool for carrying a plurality of windings of an elongated metal element.

The term "spool" also refers to a bobbin and/or a reel. The spool may be made of metal or of a synthetic material such as plastic.

Elongated metal elements such as steel wires and steel cords are conveniently wound on spools for storage at the wire or cord manufacturers and for transport to the customers.

During the past ten years continuous efforts have been made to automate the process of winding elongated metal elements on a spool, including the step of fixing the leading end of the elongated element, i.e. the end of the elongated element at empty spool.

The design of the spool and/or the process of winding must fulfill a plurality of requirements in order to be automated appropriately.

A first requirement is that the least possible amount of damage on the elongated element must occur during the beginning of the winding process and during the winding process itself.

A second requirement is that waste of the elongated element is to be avoided as much as possible. This means that, during unwinding and after being unwound, the elongated element should be used over its entire length, i.e. from the trailing end (the cord end at full spool) to the leading end (the cord end at empty spool).

A third requirement is that fixing means used to fix the leading end during the beginning of the winding process must not lead to residual products which fall on the floor during the subsequent unwinding process and which pollute the working environment.

A fourth requirement is that no time losses must occur during winding and unwinding. This means that the fixing and unfixing of the trailing end should be done in a short time period.

A fifth requirement is that the great mass of existing metal spools now in use, should be preferably used—with or without some necessary adaptations—in the eventually automated process.

Yet another requirement is that adaptations to the existing spools do not lead to loss of the mechanical strength of the spools and especially of the core of the spools.

Despite continuous efforts in the field, it has been found difficult to meet all of the above-mentioned requirements and to develop a spool and a winding process that can be automated.

SUMMARY OF THE INVENTION

It is an object of the present invention to provide a spool and a process of winding the spool, whereby the spool and the process are such that the process can be automated, that no substantial damage on the elongated element occurs, that substantial waste of the elongated element is avoided, that residual products which pollute the working environment are avoided, that no time losses occur and that the great mass of existing metal spools can still be used without leading to loss of mechanical strength of these spools.

According to a first aspect of the present invention, there is provided a method of winding an elongated metal element to a spool. The elongated element comprises hereby a leading end, i.e. the end at empty spool. The spool comprises a core and two flanges. The core and/or at least one of the flanges comprises at least one reference mark. The core further comprises at least one fixing hole. The fixing hole is located at a predetermined distance from the reference mark.

The method comprises the following steps:

(i) plastically bending the leading end of the elongated element thereby creating a bent part;

(ii) locating the reference mark;

(iii) putting the bent part of the leading end in the fixing hole;

(iv) pressing the elongated element by means of a roller to the core;

(v) rotating the spool over a number of turns in the winding direction at a predetermined first rotation speed;

(vi) removing the roller from the elongated element; and (vii) further rotating the spool in the winding direction at a predetermined second rotation speed.

Within the context of this invention the term "hole" shall mean either a common hole or a recess with a sufficient depth to perform the function of a common hole.

As a consequence, a "fixing hole" also comprises a recess with a sufficient depth to hold the bent part of the leading end of the elongated element.

The above-mentioned method can be automated.

With respect to the above-mentioned requirements:

—apart from the plastical deformation of the leading end, no damage occurs to the elongated element and no waste is created;

—no residual products, such as adhesive tapes which pollute the working environment, are used;

—the above-enumerated steps can be carried out without loss of time;

—existing spools can be easily provided with a reference mark and with fixing holes without leading to a substantial loss of mechanical strength.

The reference mark may take a lot of possible forms dependent upon the method of locating the reference mark. If, by way of one example, the method of locating the reference mark is an optical method, an optical reference mark is used on the spool.

If, by way of another example, the method of locating the reference mark is an electromagnetic method, a magnetic strip can be used as reference mark on the core or on the flange of the spool.

Preferably, the reference mark is a hole ("reference hole") in the core of the spool and the reference hole is located mechanically and simply by means of a pin. The pin is brought under a certain pressure into contact with the core of the spool at a predetermined distance from one of the flanges. This distance is the same distance between the reference hole and one of the flanges. Preferably, the reference hole is in the middle of the core between the two flanges. The spool is then rotated relatively to the pin. As soon as the reference hole passes the pin, the pin is pushed into the reference hole. The size of the pin is such that it fits exactly into the reference hole. As a consequence, the rotation of the spool is stopped at an exactly predetermined place which unambiguously determines the position of a fixing hole.

The term "reference hole" also comprises a recess with a sufficient depth to hold the pin and stop the rotation of the spool.

The first rotation speed may be smaller than the second rotation speed.

According to a second aspect of the present invention, there is provided an apparatus for winding an elongated metal element to a spool. The elongated element comprises a leading end. The spool comprises a core and two flanges. The core and/or at least one of the flanges comprise at least one reference mark. The core comprises at least one fixing hole.

The apparatus comprises:

—means for plastically bending the leading end of the elongated element thereby creating a bent part;

—means for locating the reference mark on the core;

—means for putting the bent part of the leading end in the fixing hole;

—means for pressing the elongated element to the core of the spool; and

—means for rotating the spool in the winding direction.

Preferably, the reference mark is a hole ("reference hole") and the means for locating the reference hole comprise a pin.

According to a third aspect of the present invention, there is provided a spool for carrying a plurality of windings of an elongated metal element. The elongated element comprises a leading end. The said spool comprises a core and two flanges. The core comprises at least one fixing hole to fix the leading end of the elongated element to the core of the spool. The core and/or at least one of the flanges comprises at least one reference mark. The reference mark is located at a predetermined distance from at least one of the fixing holes in order to indicate the position of this fixing hole.

Preferably, the reference mark is a hole ("reference hole") and is located on the core of the spool.

The fixing holes and the reference hole(s) may or may not be circular.

If the fixing holes and the reference hole(s) are circular, the diameter of the reference hole(s) may or may not be greater than the diameter of the fixing holes.

The diameter of the reference hole may be greater than 10 mm and if the elongated element is a steel cord for tire reinforcement, the diameter of the fixing hole may be smaller than 5 mm.

In any way, the fixing holes are separate and distinctive from the reference hole(s).

A preferable embodiment of the spool is as follows:

The reference hole is located on the core in the middle between the two flanges. Two fixing holes are provided at a same predetermined distance from the reference hole, diametrically face to face with one another.

BRIEF DESCRIPTION OF THE DRAWINGS

The invention will now be explained in more detail with reference to the accompanying drawings wherein.

DESCRIPTION OF THE PREFERRED EMBODIMENTS

Figure 1:
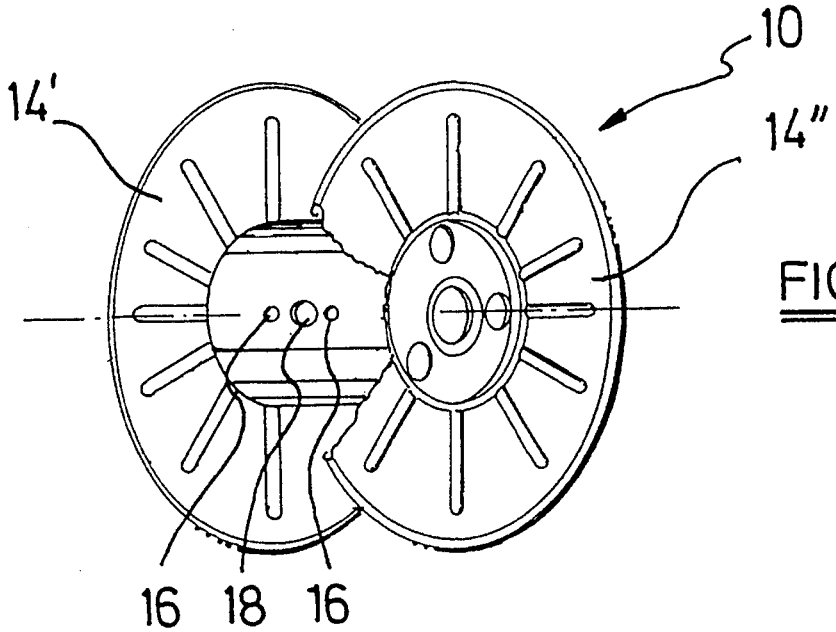
FIGS. 1 to 4 show embodiments of a spool according to the present invention.

FIG. 1 represents a preferable embodiment of a spool 10 according to the present invention. The spool comprises a core 12 and two flanges 14' and 14". Part of flange 14" has been dropped in the figure in order to show clearly core 12. The core 12 comprises two fixing holes 16 and a reference hole 18. The reference hole 18 is located in the middle between the two flanges 14' and 14" The two fixing holes 16 are arranged symmetrically with respect to the reference hole 18. The centers of the fixing holes 16 and the center of reference hole 18 lying on a same plane which also comprises the axis of the spool 10.

The advantage of the spool 10 of FIG. 1 is that the spool 10 is symmetrical, which means that it does not matter in which way the spool 10 is put on an axle: with flange 14' first or with flange 14" first; in both ways there is a fixing hole 16 on both sides of reference hole 18.

Examples of dimensions of the spool are as follows:

If the elongated element is steel cord for tire reinforcement, the diameter of the flanges is about 250 mm. The distance between the flanges may be between 150 and 320 mm. The capacity of these types of spools is from 15 up to 40 kg or more of steel cord. The diameter of the fixing holes may be about 4 mm and the diameter of the reference hole may be about 12 mm.

For steel cord adapted for the reinforcement of conveyor belts the dimensions may be greater: the diameter of the flanges may be up to 800 mm and the capacity up to 400 kg; the diameter of the fixing holes 16 must be larger than the diameter of the steel cord and may be up to 40 mm.

Figure 2:
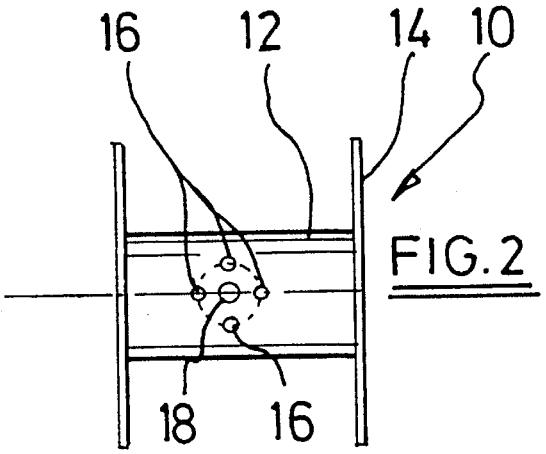

FIG. 2 illustrates another embodiment of a spool 10 according to the invention. The core 12 of the spool comprises four fixing holes 16 symmetrically arranged around a reference hole 18.

Figure 3:
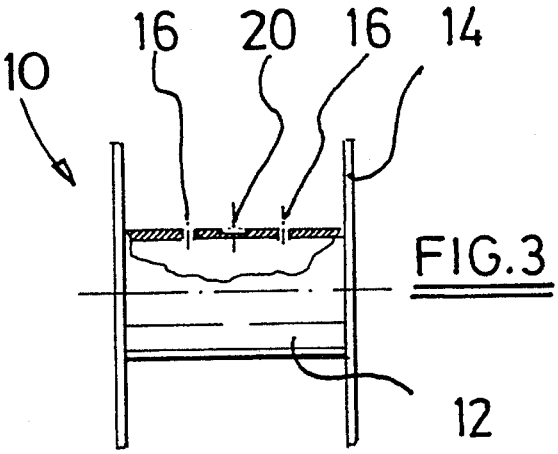

In the spool of FIG. 3 the reference mark is not a reference hole but a recess 20 in the core 12 of spool 10. This recess 20 can also be easily located by means of a pin.

Figure 4:
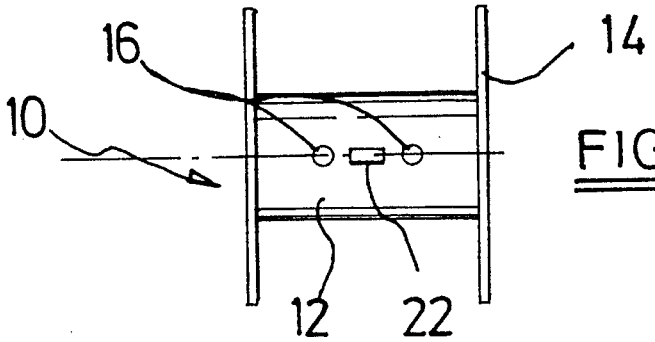
Figure 5A:
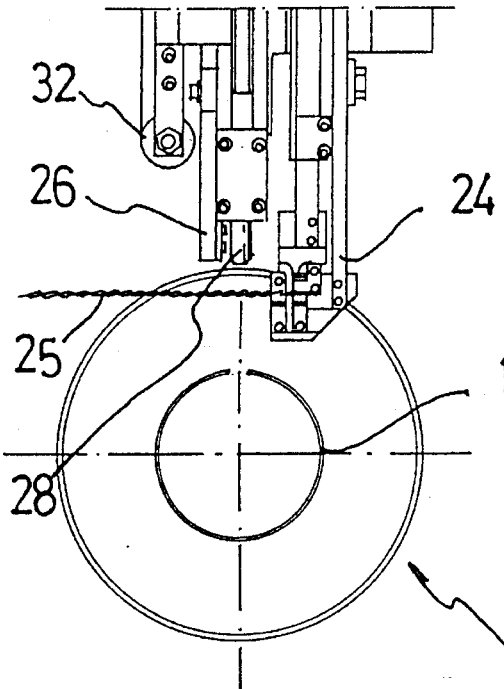
FIGS. 5(*a*) to 5(*d*) illustrate steps of a method of winding an elongated element to a spool, according to the first aspect of the present invention.
Figure 5B:
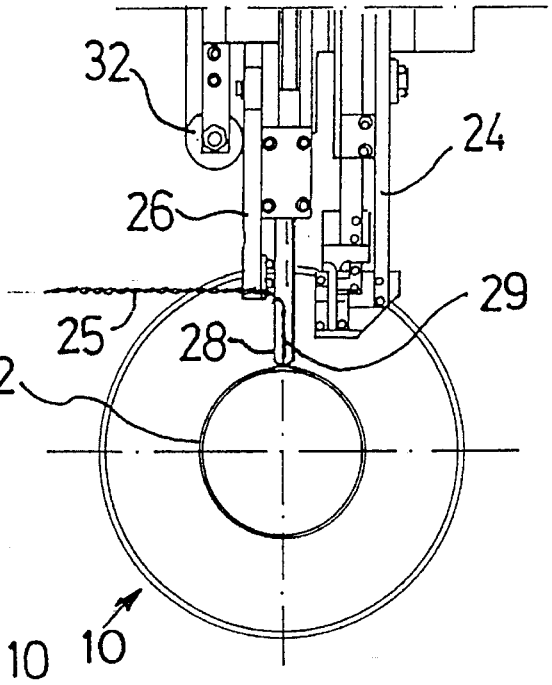
Figure 5C:
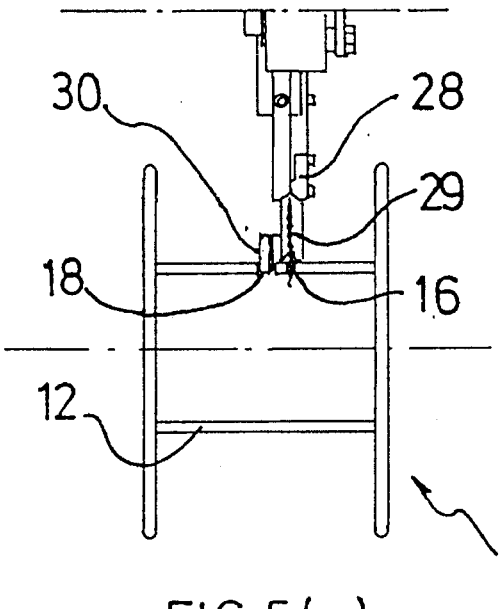
Figure 5D:
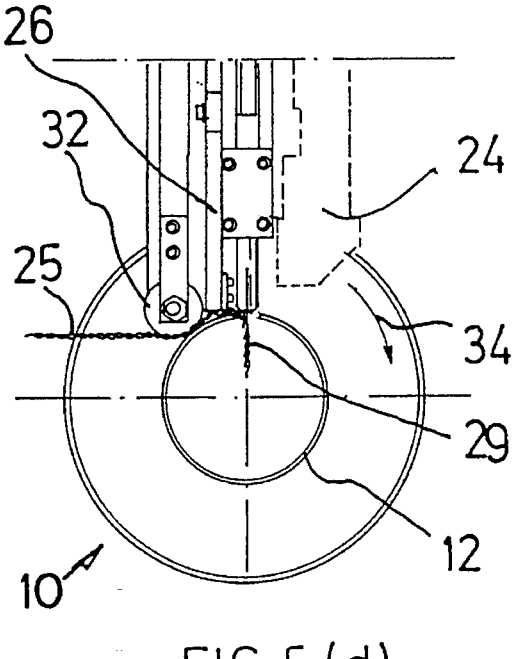

FIG. 4 illustrates a spool 10 where the reference hole 22 ii not circular but rectangular.

FIGS. 5(*a*) to 5(*d*) illustrates severals steps of a method of winding an elongated metal element on a spool, and more particularly, of fixing the leading end of the elongated metal element on the core of the spool.

FIG. 5(*a*) illustrates the situation where an electrical heating apparatus 24 with electrodes has just fused steel cord 25 into two parts, thereby creating a trailing end (not shown) of the previous full spool (not shown) and a leading end for the present empty spool 10. The leading end of the elongated element 25 is held by the heating apparatus 24.

The next step is illustrated in FIG. 5(*b*)—side view—and and FIG. 5(*c*)—front view. A gripper 26 is moved slightly downwards and grips the steel cord 25. The heating apparatus 24 releases the steel cord 25.

Next, an arm 28 which is positioned between the heating apparatus 24 and the gripper 26, is moved downwards and bends the leading end of the steel cord 25 plastically, thereby creating a bent part 29.

Fixedly connected to the arm 28 is a pin 30 (FIG. 5(*c*)). The arm 28 is further moved downwards until the pin 30 contacts the surface of the core 12. While contacting the surface of the core 12, the pin 30 is continuously held under a pressure in the downward direction. The spool 10 is rotated until the pin 30 reaches the reference hole 18, moves downwards in the reference hole 18, and stops the rotation of the spool 10, which is the situation of FIG. 5(*c*).

FIG. 5(*d*) shows the subsequent steps: once the pin 30 has pinched the spool 10, the gripper 26 is moved downwards and puts the bent part 29 of steel cord 25 in one of the fixing holes 16. The gripper 26 releases steel cord 25.

A guiding roller 32 moves together with the gripper 26 downwards and presses steel cord 25 to the surface of the core 12.

Next the pin 30 is moved upwards and releases the reference hole 18. The spool is then rotated in the direction of the arrow 34 in order to wind a couple of windings in a number sufficient to hold the steel cord 25 to the core 12 without guiding means.

The guiding roller 32 is subsequently moved upwards and winding of the steel cord 25 to the spool 10 is continued with an accelerated speed.

Figure 6:
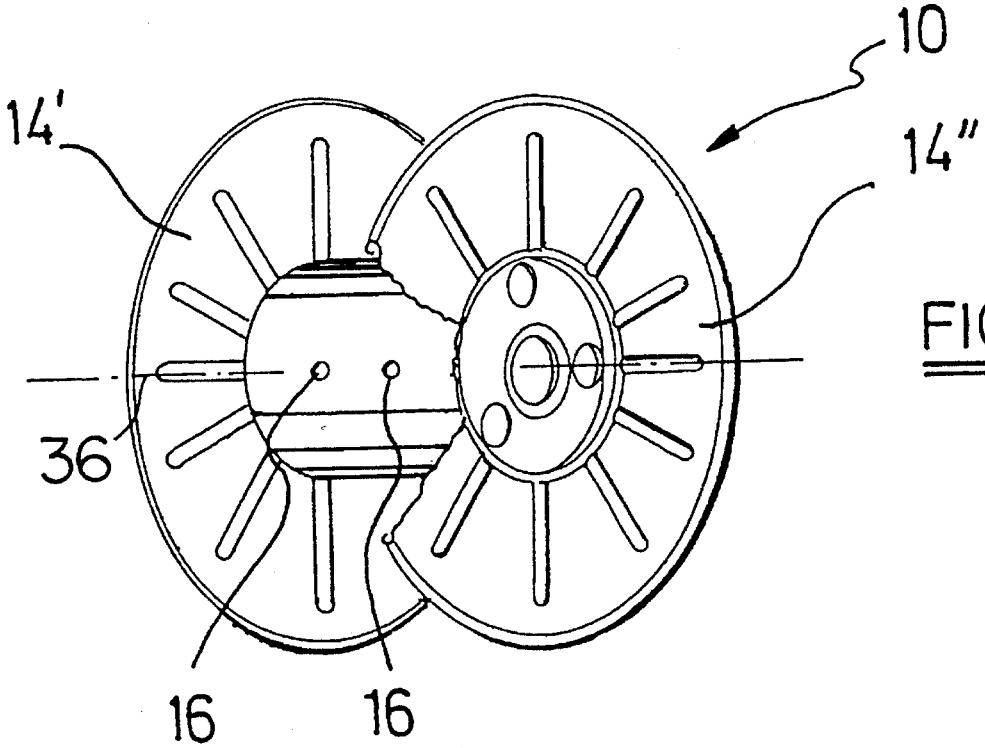

FIG. 6 illustrates a spool 10 where the reference mark is a magnetic strip 36 on one of the flanges 14'.

The above-mentioned movements of the different parts of the apparatus for winding the elongated element, may be carried out by hydraulic, by pneumatic or by electrical means and can be automated.

I claim:

1. A method of winding an elongated metal element to a spool, the elongated element comprising a leading end;

the spool comprising a core;

the core comprising at least one reference mark and at least one fixing hole;

the fixing hole being located at a predetermined distance from the reference mark;

the method comprising:

(i) plastically bending the leading end of the elongated element thereby creating a bent part;

(ii) locating the reference mark to determine the position of the fixing hole;

(iii) putting the bent part of the leading end in the fixing hole.

2. A method according to claim 1 wherein the reference mark is one of a hole and recess, and wherein the reference mark is located by means of a pin.

3. A method according to claim 1, the method further comprising:

(iv) pressing the elongated element by means of a roller to the core;

(v) rotating the spool under the roller over a number of turns in the winding direction at a predetermined first rotation speed.

4. A method according to claim 3, the method further comprising:

(vi) removing the roller from the elongated element;

(vii) further rotating the spool in the winding direction at a predetermined second rotation speed.

5. A method according to claim 4 wherein step (v) is done at a first rotation speed which is slower than the second rotation speed for step (vii).

6. A method of winding an elongated metal element to a spool;

the elongated element comprising a leading end, the spool comprising a core and two flanges;

at least one of the flanges comprising at least one reference mark;

the core comprising at least one fixing hole;

the at least one fixing hole being located at a predetermined distance from the at least one reference mark;

the method comprising:

(i) plastically bending the leading end of the elongated element thereby creating a bent part;

(ii) locating the at least one reference mark to determine the position of the at least one fixing hole;

(iii) putting the bent part of the leading end in the at least one fixing hole.

7. An apparatus for winding an elongated metal element to a spool;

the elongated element comprising a leading end;

the spool comprising a core;

the core comprising at least one reference mark and at least one fixing hole;

the apparatus comprising:

means for plastically bending the leading end of the elongated element thereby creating a bent part;

means for locating the at least one reference mark on the core to determine the position of the at least one fixing hole;

means for putting the bent part of the leading end in the at least one fixing hole.

8. An apparatus according to claim 7 wherein the reference mark is one of a reference hole and reference recess, and the means for locating the reference mark on the core comprises a pin.

9. An apparatus according to claim 7 wherein the apparatus further comprises:

means for pressing the elongated element to the core of the spool.

10. An apparatus according to claim 9 wherein the apparatus further comprises:

means for rotating the spool in the winding direction.

11. An apparatus for winding an elongated metal element to a spool;

the elongated element comprising a leading end;

the spool comprising a core and two flanges;

at least one of the flanges comprising at least one reference mark;

the core comprising at least one fixing hole; the apparatus comprising:

means for plastically bending the leading end of the elongated element thereby creating a bent part;

means for locating the at least one reference mark on the core to determine the position of the at least one fixing hole;

means for putting the bent part of the leading end in the at least one fixing hole.

12. A spool for carrying a plurality of windings of an elongated metal element, said element comprising a leading end;

said spool comprising a core;

said core comprising at least one fixing hole adapted to fix the leading end of the element to the core of the spool;

said core further comprising at least one reference mark;

said at least one reference mark being located at a predetermined distance from at least one of said at least one fixing holes in order to indicate the position of said at least one fixing hole.

13. A spool according to claim 12 wherein said at least one reference mark is one of a reference hole and reference recess.

14. A spool according to claim 13 wherein the reference hole and the at least one fixing hole are circular.

15. A spool according to claim 14 wherein the reference hole has a diameter which is greater than the diameter of the fixing holes.

16. A spool according to claim 15 wherein the diameter of the reference hole is greater than 10 mm and the diameter of the fixing holes is smaller than 5 mm.

17. A spool according to claim 13 wherein the spool further comprises two flanges and wherein the at least one reference mark is one reference hole which is located on the core in the middle between the two flanges.

18. A spool according to claim 17 wherein two fixing holes are provided and are located at a same predetermined distance from the one reference hole, diametrically face to face with one another.

19. A spool according to any of claim 12 wherein two fixing holes are provided on the core.

20. A spool according to claim 12, said at least one fixing hole is adapted to hold a bent part of said leading element.

21. A spool for carrying a plurality of windings of an elongated metal element, said element comprising a leading end;

said spool comprising a core and two flanges;

said core comprising at least one fixing hole to fix the leading end of the element to the core of the spool;

said flanges comprising at least one reference mark;

said reference mark being located at a predetermined distance from at least one of said fixing holes in order to indicate the position of said fixing hole.

22. A method of automating the winding of an elongated element onto a spool, the method comprising the steps of (a) providing a spool having a core and two flanges;

(b) providing at least one fixing hole into the core of the spool;

(c) providing at least one reference mark on the core at a predetermined distance from the at least one fixing hole;

(d) locating the at least one fixing hole by looking for the at least one reference mark.

23. A method of automating the winding of an elongated element onto a spool, the method comprising the steps of (a) providing a spool having a core and two flanges;

(b) providing at least one fixing hole into the core of the spool;

(c) providing at least one reference mark on at least one of the flanges; (d) locating the at least one fixing hole by looking for the at least one reference mark.

24. A method of automating the winding of an elongated element onto a spool, the method comprising the steps of (a) providing a spool having a core and two flanges;

(b) providing at least one fixing hole into the core of the spool;

(c) providing at least one reference mark in the core;

(d) locating the at least one fixing hole by looking for the at least one reference mark.

25. A method of automating the winding of an elongated element onto a spool, the method comprising the steps of (a) providing a spool having a core and two flanges;

(b) providing at least one fixing hole into the core of the spool;

(c) providing at least one reference mark in at least one of the flanges;

(d) locating the at least one fixing hole by looking for the at least one reference mark.

* * * * *